US006712433B2

(12) United States Patent
Hellwig et al.

(10) Patent No.: US 6,712,433 B2
(45) Date of Patent: Mar. 30, 2004

(54) WORKSTATION SYSTEM

(75) Inventors: John Hellwig, Toronto (CA); Geoffrey Milligan, East York (CA); Steve Verbeek, Aurora (CA); Lorie Marangoni, Weston (CA); Genadij Makarewicz, Brampton (CA); Terry Woodside, Toronto (CA); Stefano Lio, Toronto (CA); Zoran Baic, Mississauga (CA); Jonathon Loudon, Toronto (CA); Dakota Kasdorf, Barrie (CA); Paul Kruger, Scarborough (CA)

(73) Assignee: TK Canada Limited, Downsview (CA)

( * ) Notice: Subject to any disclaimer, the term of this patent is extended or adjusted under 35 U.S.C. 154(b) by 109 days.

(21) Appl. No.: 10/093,913

(22) Filed: Mar. 11, 2002

(65) Prior Publication Data

US 2002/0153812 A1 Oct. 24, 2002

(30) Foreign Application Priority Data

Apr. 12, 2001 (CA) ..... 2343861

(51) Int. Cl.[7] ..... A47B 81/00

(52) U.S. Cl. ..... 312/223.6; 312/223.3; 312/196

(58) Field of Search ..... 312/223.3, 223.6, 312/194, 195, 196, 140.4; 108/50.01, 50.02

(56) References Cited

U.S. PATENT DOCUMENTS

| | | | | | |
|---|---|---|---|---|---|
| 4,094,561 | A | * | 6/1978 | Wolff et al. | 312/223.6 |
| 4,258,963 | A | * | 3/1981 | Fusselman et al. | 312/194 |
| 4,323,291 | A | * | 4/1982 | Ball | 312/194 |
| 4,458,961 | A | * | 7/1984 | Browning | 312/223.3 |
| 4,637,666 | A | * | 1/1987 | Worrell et al. | 312/196 |
| 5,231,562 | A | * | 7/1993 | Pierce et al. | 361/832 |
| 5,746,488 | A | * | 5/1998 | LaCour | 312/196 |
| 5,971,508 | A | * | 10/1999 | Deimen et al. | 312/223.6 |
| 5,988,076 | A | * | 11/1999 | Vander Park | 108/50.02 |
| 6,283,043 | B1 | * | 9/2001 | Stern et al. | 108/50.02 |

FOREIGN PATENT DOCUMENTS

| | | | | |
|---|---|---|---|---|
| EP | 10301 | * | 4/1980 | 108/50.02 |

* cited by examiner

*Primary Examiner*—James O. Hansen
(74) *Attorney, Agent, or Firm*—Bereskin & Parr

(57) ABSTRACT

A workstation system includes, as a "core" element, a self-standing service trunk that can be used in association with free-standing desks placed adjacent the trunk, or desk structures that are physically connected to the trunk. The trunk has a top that provides a generally horizontal storage support surface above desk height, and the trunk incorporates power and communication cable troughs for delivering power and communication services from an input location on the trunk to an output location accessible from a desk associated with the trunk.

16 Claims, 6 Drawing Sheets

30
32
54
52
30b
30a
56
80
80
82
82
58
66a
36
36
42
42
48
60
60
66b
50
50
50

WORKSTATION SYSTEM

FIELD OF THE INVENTION

This invention relates generally to office furniture and more particularly to workstations for use in office environments.

BACKGROUND OF THE INVENTION

Office workstations are available in a wide variety of designs, ranging from individual free-standing desks to complex partition systems. A typical partition system may comprise groupings of inter-connected wall panels that are arranged to define individual work areas containing desks that may either be free-standing or hung off the panels. Typically, at least some of the panels inter-connect at right angles to provide stability to the partition system overall.

The partition system may have a fixed configuration with the wall panels extending from floor to ceiling. More usually, however, the panels are lower than full height and the partition system is designed so that it can be reconfigured to suit changing work environment requirements.

Cables for providing power and data communications services may be routed through the panels themselves to appropriate locations within the work areas. Typically, cabling is run overhead and then brought down through the wall panels to work height. Where the wall panels are less than full height, cabling can be run through a column or pole that extends upwardly from the workstation system to the ceiling.

A partition based workstation system has a number of advantages, particularly in terms of flexibility of overall configuration, and ease of reconfiguration as needs change. However, care must be taken when setting up or re-configuring a partition system to ensure that the panels provide appropriate support and stability for the system overall. As such, there is not complete freedom of lay-out.

SUMMARY OF THE INVENTION

An object of the present invention is to provide a new approach to workstation system design.

The system provided by the invention is based on the provision of a free-standing service trunk that can be used in association with at least one desk providing a work surface at a defined working height. The service trunk comprises an elongate self-standing structure having first and second ends spaced longitudinally of the service trunk and a top that extends between the ends at a height above the defined working height of the desk and that provides a generally horizontal storage support surface. The service trunk further includes means for delivering power and/or communication services from an input location on the trunk to an output location accessible from a desk associated with the trunk.

The provision of a free- or self-standing service trunk as the central element of a workstation system represents a novel approach to workstation system design. The trunk provides a fixed "core" element around which the system can be built, using either free-standing desks placed adjacent to the trunk, or desk structures that are physically connected to the trunk or both. That is not to say that the trunk is immovable, though it usually will not be moved at frequent intervals. One or more desks can be appropriately positioned relative to the trunk and easily re-located as necessary.

Power and/or communication services are provided through the trunk. Normally, there will be a single input location for power and communications cables, and a plurality of outlets distributed along the trunk at relatively frequent intervals so that the outlets are accessible, whatever configuration of desk or desks is used. The cables can enter the service trunk at floor level, or from above via a power pole or other coupling arrangement.

In most applications, the service trunk will be provided with both power and communications cables. Preferably, the trunk incorporates troughs that extend longitudinally of both sides of the trunk below the top and above the defined desk height and appropriate outlets are provided either in the troughs themselves or in association with the troughs, for example, by way of one or more power/communications bars.

The top of the service trunk provides a support surface that can accommodate whatever form of storage is considered appropriate or necessary for the work environment. For example, the top can serve as a form of shelf that can directly receive items to be stored, or conventional storage structures such as bookcases, file cabinets or the like. Preferably, however, the workstation system includes storage cabinets that are designed specifically to be accommodated on the top of the service trunk. The top may also be designed to receive privacy screens or other elements typically found in an office environment.

Additional storage may be provided for use alongside the service trunk. Preferably, the trunk itself comprises a pair of gable ends that support opposite ends of the top, and an upright median panel that extends between the gables below the top generally on the longitudinal centreline of the trunk. This creates large recessed areas below the top on both sides of the trunk which can accommodate storage units, such as conventional file cabinets or specially designed free-standing cabinets, for example, mounted on wheels.

The median panel may also be designed to provide an array of horizontal slots into which can be hooked desk supports and other accessories for use with the service trunk.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
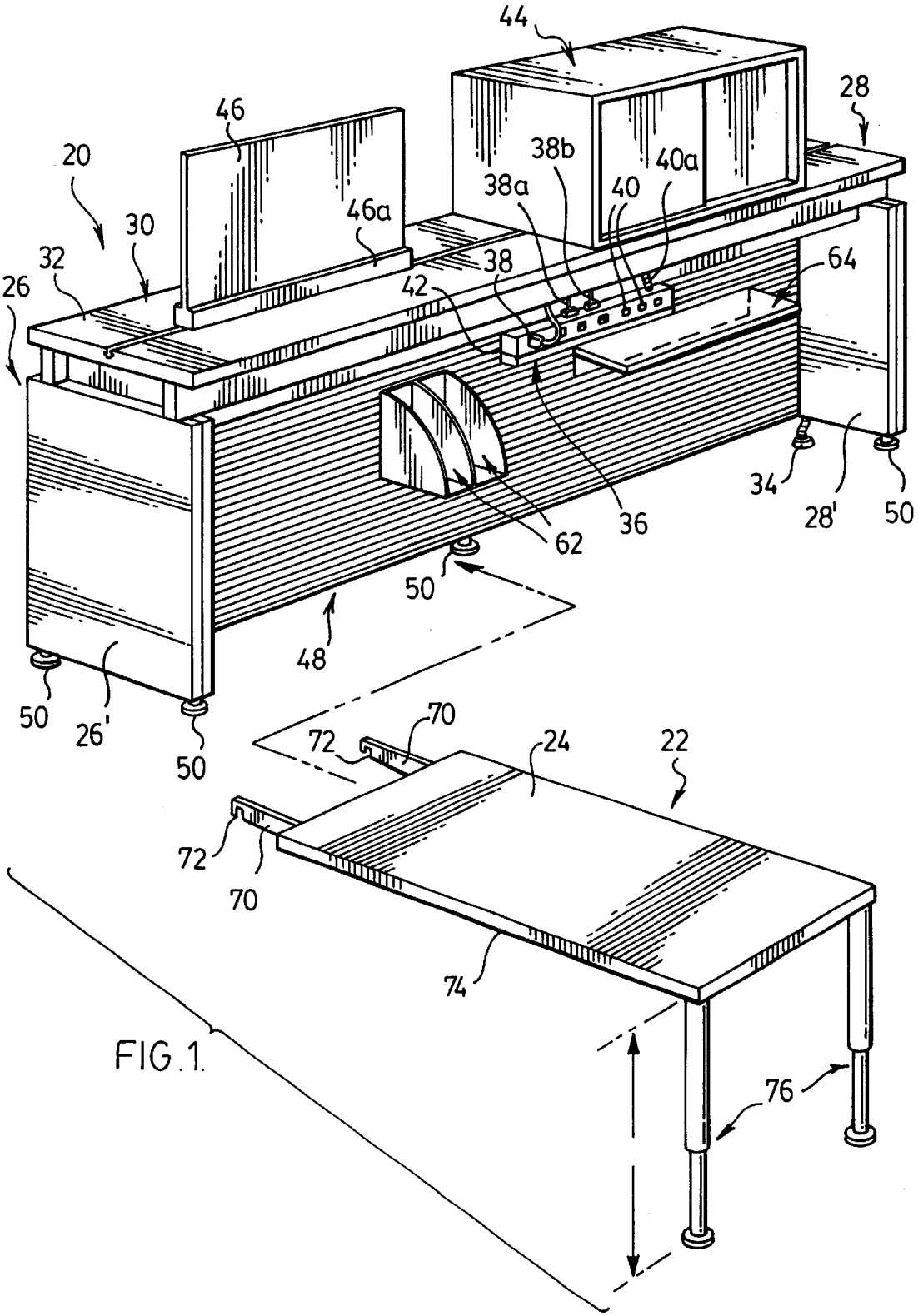
FIG. 1 is a perspective view from one end of the service trunk of a workstation system in accordance with the invention.
Figure 3:
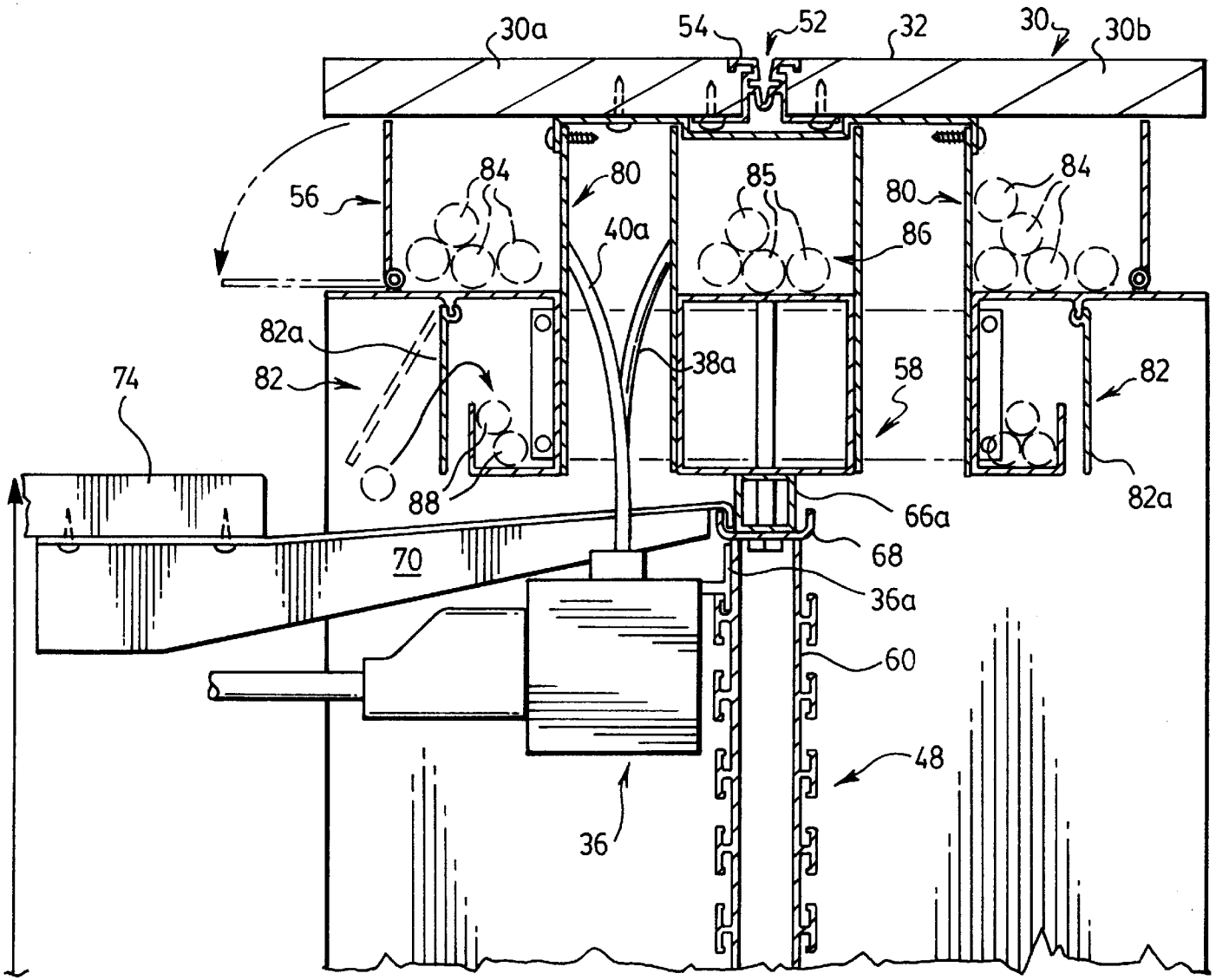
FIG. 3 is an enlarged detail view of an upper part of FIG. 2, showing additional features.

Referring first to FIG. 1, a workstation system in accordance with the invention is shown to include a service trunk 20 and a desk 22 for use in association with the trunk. The desk has a work surface 24. In FIG. 1, the desk 22 is shown in an exploded position away from the trunk 20. FIG. 3 shows part of the desk 22 installed on the service trunk and illustrates the fact that the working surface 24 of the desk is at a defined desk height H above a floor on which the service trunk is located.

Service trunk 20 is an elongate self-standing structure having first and second ends 26, 28 that are spaced longitudinally of the trunk, and a top 30 that extends between the ends at a height above the defined desk height H, as best seen in FIG. 3. The top provides a generally horizontal storage support surface 32.

The service trunk is designed to deliver power and/or communication services from an input location on the trunk to output locations accessible from one or more desks associated with the trunk. Details of how this is accomplished will be provided later. For the moment, it will be seen that FIG. 1 shows at 34 an input conduit for power and communication cables at floor level. The conduit connects to the trunk at one end and the cables are routed through the service trunk as will be described later, to provide the required services at locations that are accessible from desks such as desk 22.

In FIG. 1, a power/communications bar 36 is shown at a location below the top 30, and has a series of electrical outlets 38 and voice/data modules (VDMs) 40 that are accessible at the front face of the bar. Communications cables connecting to the VDMs 40 are shown at 40*a* and "in" and "out" plug-in cables for power are shown at 38*a* and 38*b* respectively. The power cables 38*a* and 38*b* are designed to be "daisy-chained" for interconnecting different receptacles in the same circuit, as known in the art. For example, the cables may be so-called Anderson quick-connect cables.

Figure 2:
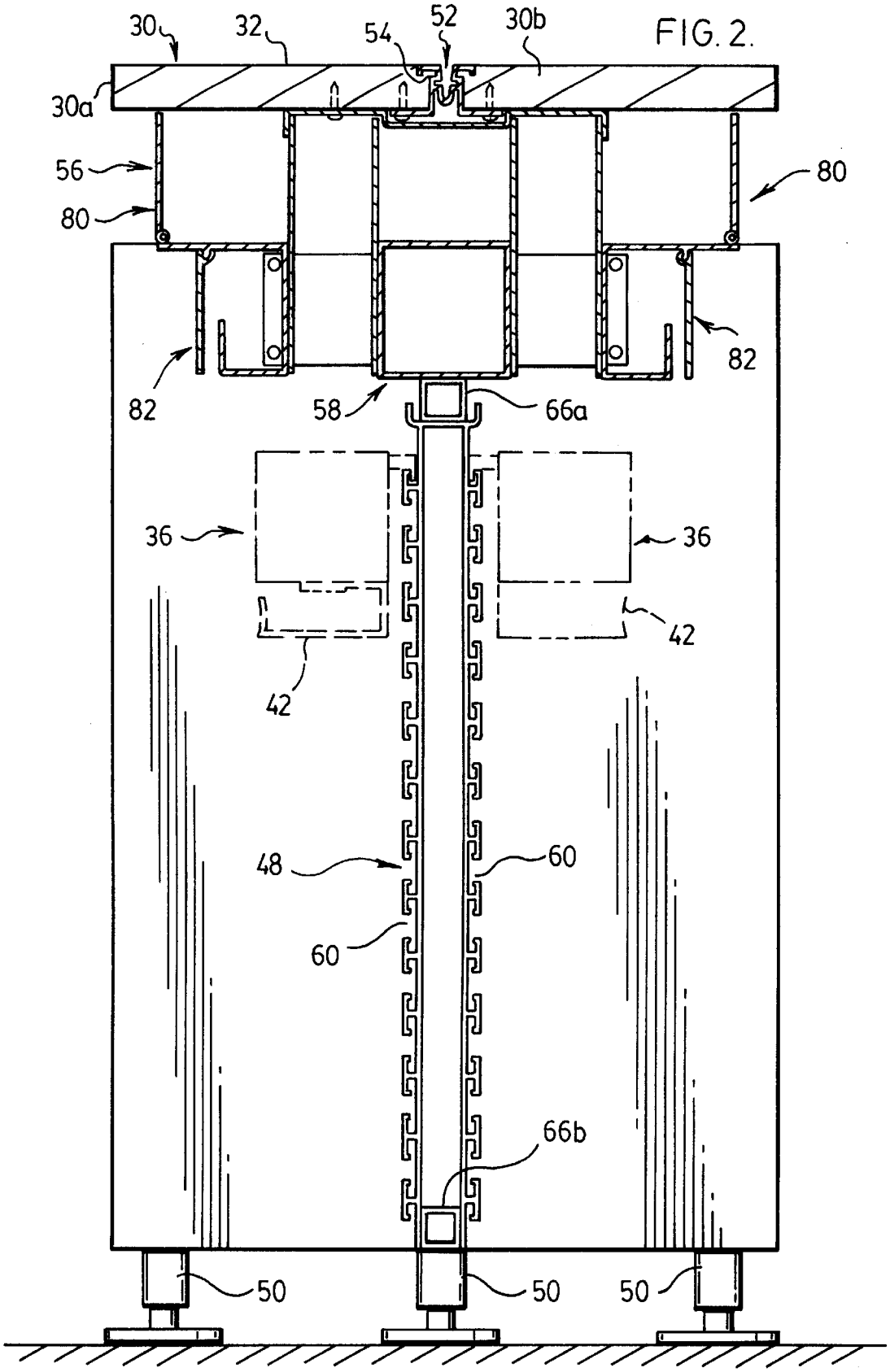
FIG. 2 is a typical vertical sectional view through the service trunk shown in FIG. 1.

As best seen in FIGS. 2 and 3 a trough-shaped wire manager 42 is provided below bar 36 to receive wiring that is plugged into the electrical outlets 38 and/or the VDMs 40.

While FIG. 1 does not purport to show a complete workstation system, the figure does illustrate how one desk (22) can be used in association with the service trunk 20. Several desks such as desk 22 can be connected to the service trunk as will be described later, or free-standing desks can be used in association with the service trunk. At the same time, the top 30 provides a support surface (32) that can accommodate almost any storage need, ranging from a single shelf-type storage to a surface that can accommodate storage cabinets such as the cabinet indicated at 44 in FIG. 1. Top 30 can also receive privacy screens such as the screen indicated at 46.

In the particular embodiment illustrated, the top 30 of the service trunk is supported at opposite ends by respective end gables 26', 28', and an upright median panel 48 extends between the end gables 26', 28' generally on the longitudinal centreline of the service trunk, as best shown in FIGS. 2 and 3.

Each end gable comprises a pair of rectangular panels secured together face-to-face, and each gable is provided along its bottom edge with two adjustable feet 50, by which the gable can be levelled. Top 30 comprises two flat rectangular boards 30*a*, 30*b* that are positioned side-by-side and spaced slightly from one another to define a slot 52 that receives a generally V-shaped extrusion 54. Extending longitudinally of the service trunk below the top 30 and supported on the top edges of the two gables 26', 28' are a series of aluminum extrusions 56 that both support the top 30 on the gables and provide troughs for receiving power and communication cables, as best seen in FIG. 3 (to be described).

Below the top 30 and centred on slot 52, a steel beam 58 extends longitudinally of the service trunk and carries the median panel 48. It can be seen that the two opposite faces of panel 48 are defined by respective extrusions 60 that are identical. The extrusion is shaped to provide an array of undercut T-section slots that extend horizontally of the panel 48. The slots provide multiple hook-in attachment locations by which accessories can be coupled to the median panel 48. A few examples of typical such accessories are shown in FIG. 1 and comprise the power/communications bar 36 referred to previously, file hangers 62 and a shelf 64.

It will be appreciated that the slot arrangement described provides wide flexibility for positioning accessories on the median panel 48. Of course, such accessories need not be used and the panel could be left "as is" or the extrusion 60 could even be replaced by plain panels or panels having some other form of attachment regime.

For reasons of electrical safety, in the illustrated embodiment, the power/communications bars 36 are movable horizontally along panel 48, but not vertically. A T-section extrusion 36*a* (FIG. 3) is used at the back of each bar 36 to suspend the bar from panel 48 and is too large to fit other than in the top slot provided by extrusion 60.

FIG. 2 also illustrates the fact that the provision of a central median panel as panel 48 allows for wide unobstructed spaces on both sides of the trunk, below the top 30. These spaces can be used to accommodate static or movable storage cabinets, such as file cabinets or wheeled cabinets that are specially designed to be used in association with the service trunk.

The two extrusions 60 of median panel 48 are attached to opposite sides of a rectangular frame, upper and lower longitudinal members of which are shown at 66*a* and 66*b* respectively. The upper frame member 66*a* is located in a channel member 68 that is wider than the extrusion so as to provide a gap between the extrusion and the channel member at each side for accommodating hook-on accessories such as the desk 22 shown in FIG. 1. Desk 22 in fact has a pair of arms 70 that project outwardly from an inner end of the top of the desk and that are shaped to provide hooks 72 to engage over one side limb of channel 68. Channel 68 extends over the whole length of panel 48 and thereby provides an infinite number of attachment locations for a desk or other accessory that is to be coupled structurally with the trunk.

As noted previously, several similar desks 22 can be used in association with the same trunk and can be located wherever appropriate along the length of the trunk, at both sides. In this embodiment, each desk simply comprises a top panel 74 that provides the work surface 24 of the desk, and upright legs 76 that have a height selected to "match" the height of the channel 68 (FIG. 3) above the floor surface on which the trunk is located. Again, adjustable feet 78 are provided at the bottom ends of the legs 76.

FIGS. 2 and 3 show that the extrusions 56 immediately below the top 30 of the service trunk provide, at each side of the trunk below the top 30, upper and lower cable troughs 80 and 82 respectively. In this particular embodiment, the two top troughs 80 are lay-in troughs for communications cables (specifically data cables) 84 which run longitudinally of the trunk and connect as appropriate to one or more of the power/communications bars 36.

Power cables 85 extend longitudinally of the service trunk from the input location (e.g. location 34 in FIG. 1) along a central trough 86 above beam 58 and incorporate Anderson connectors (as discussed previously) so that the cabling can be configured as appropriate to the particular workstation configuration. This cabling system is of course also reconfigurable if required. As such, the system provides flexibility in terms of locating electrical outlets (via bars 36) that are accessible from desks used in association with the trunk.

As can be seen, the power/communications bars 36 are located below desk height so that electrical components on the desks can be plugged into the appropriate bar using cables that are routed down over the rear edge of the top surface 24 of the desk generally as indicated at 40' in FIG. 3.

The lower troughs 82 are so-called "casual" wire management troughs and accommodate equipment cables (power and data) indicated at 88. These troughs have hinged outer doors 82*a* that provide access to the troughs for easy cable lay-in and re-routing.

Figure 4:
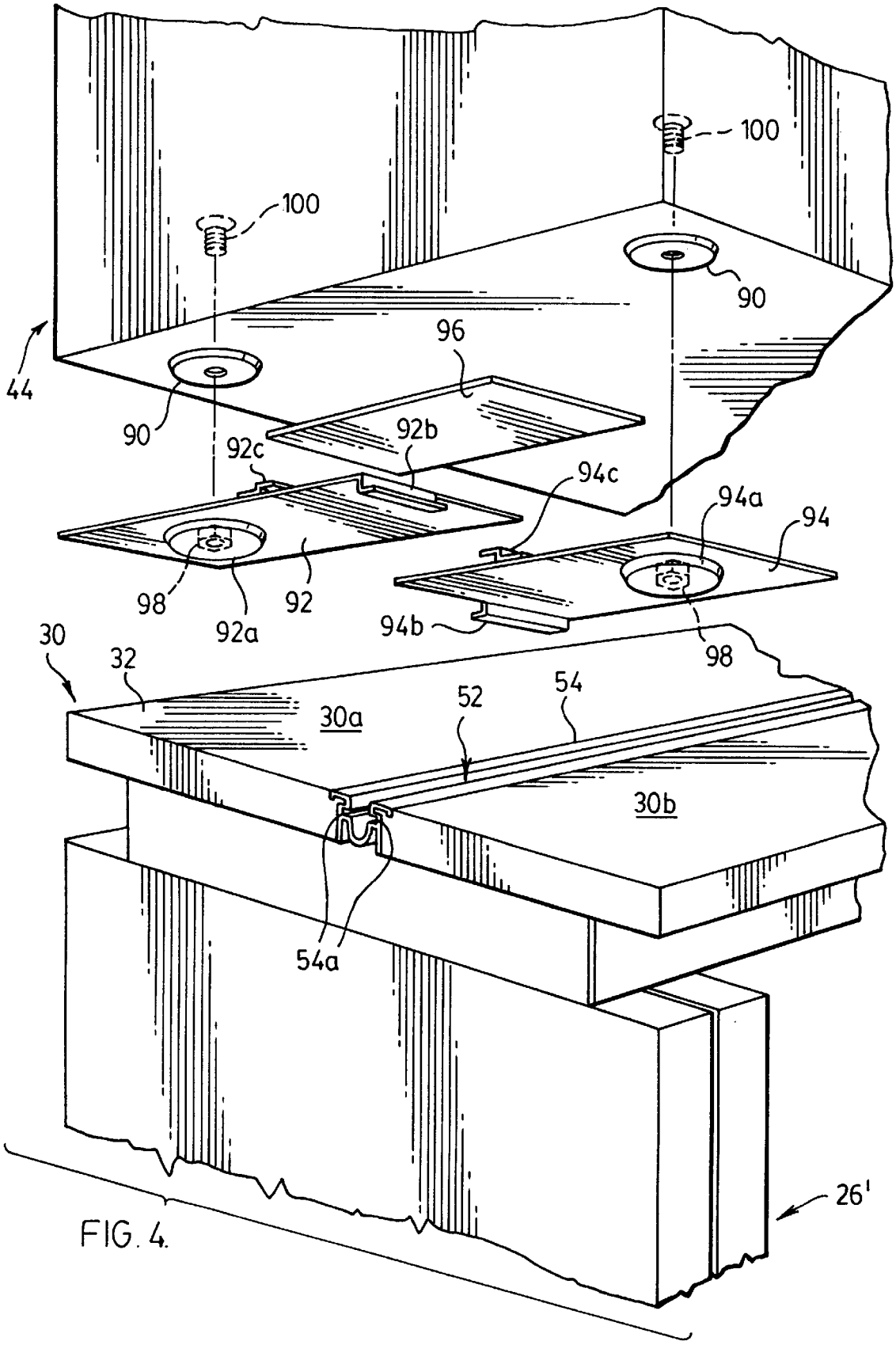
FIG. 4 is an exploded perspective view showing the underside of a storage cabinet in association with the top of the service trunk.
Figure 5:
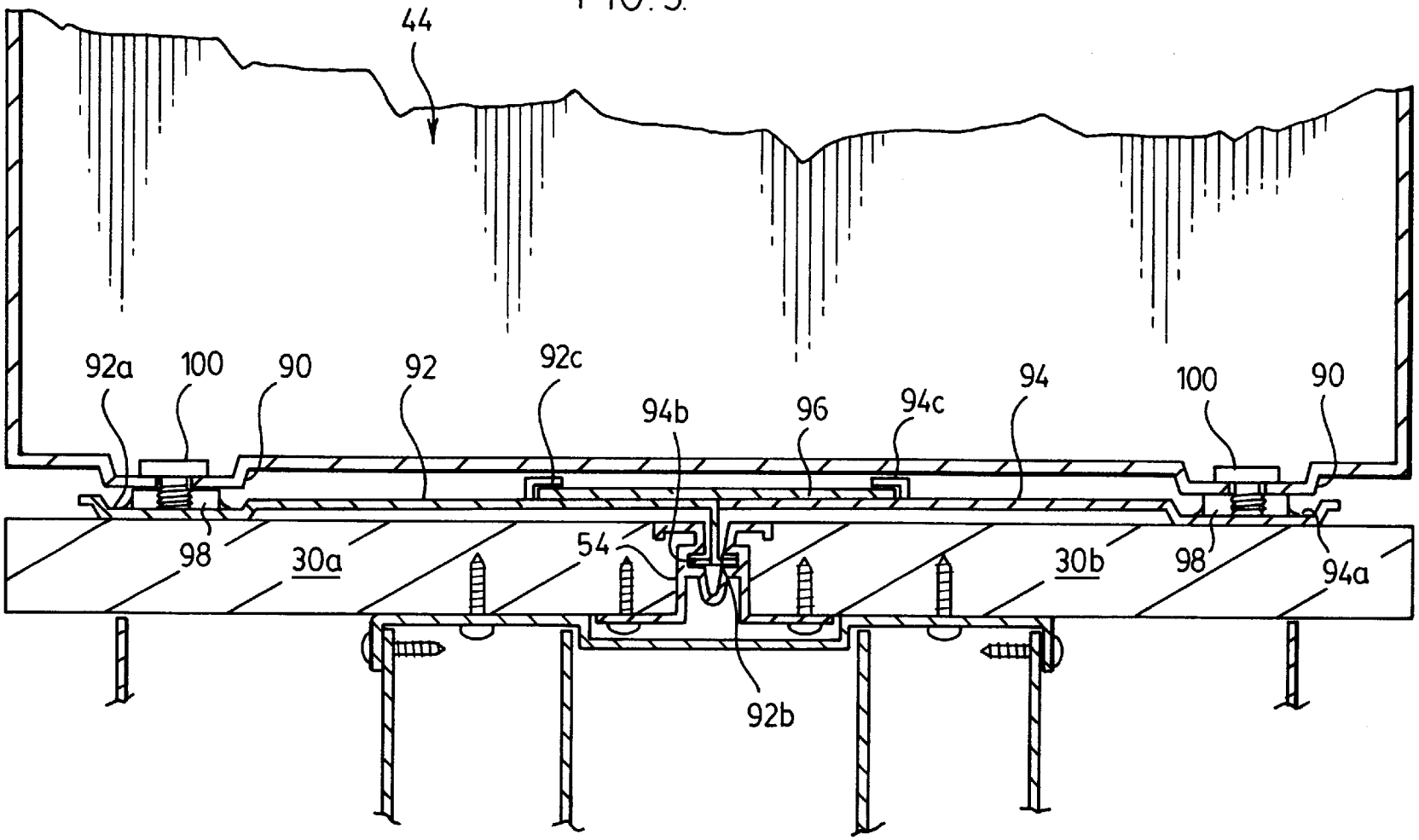
FIG. 5 is a vertical sectional view showing the cabinet of FIG. 4 installed on the top of the service trunk; and, FIG. 6 is a perspective view of an end portion of the service trunk showing an input conduit for power and communications cables.

As noted previously, the top of the service trunk provides a support surface 32 that preferably accommodates storage cabinets such as the cabinet shown at 44 in FIG. 1. FIGS. 4 and 5 show a lower portion of cabinet 44 in association with top 30 and illustrate the manner in which the storage cabinet can be coupled to the top 30. It is of course to be understood that, in other embodiments, free-standing storage cabinets could be used.

Referring first to FIG. 4, it will be seen that the cabinet has two disc-shaped protrusions 90 in corner regions of its bottom surface. Similar protrusions are in fact provided in all four corner regions of the bottom surface of the cabinet. Corresponding complimentary recesses are provided in corner regions of the top surface of the cabinet (but are not shown) so that identical cabinets are stackable on top of one another and are then restrained against lateral displacement.

FIG. 4 shows how a cabinet can be in effect locked to the top 30 of the service trunk using these protrusions. This is accomplished through the intermediary of attachment plates 92, 94. The plates have respective recesses 92*a* and 94*a* for accommodating the protrusions 90 on the underside of the cabinet. Inner edges of the respective plates 92, 94 are provided with dependent hook-shaped formations 92*b* and 94*b* respectively that can be individually hooked into the central groove 52 that is provided in the top 30. It will be seen that the extrusion 54 that fits into groove 52 is shaped to provide respective laterally directed groove portions 52*a* at both sides that receive the hooks 92*b*, 94*b*. The hooks are complimentarily offset with respect to one another in the longitudinal direction of groove 52 so that they can be hooked independently into the grooves 54*a* and the plates 92, 94 will then lie flat on the top surface 32 of top 30, as best seen in FIG. 5. A locking plate 96 is then slid longitudinally between respective angled formations 92*c* and 94*c* at the tops of the respective plates. Captive nuts 98 within the respective recesses of the two plates then receive bolts 100 that are threaded downwardly through the protrusions 90, effectively securing the cabinet to the two plates 92, 94 and locking the cabinet to the top 30.

The same attachment method normally will be used at both ends of the cabinet.

Screen 46 (FIG. 1) is coupled to groove 52 by means of an extrusion 46*a* that extends along the lower edge of the screen and that has a depending rib with a V-shaped profile (not shown) that fits stably into groove extrusion 54, while allowing the screen to be simply lifted out of the groove for re-configuration.

Figure 6:
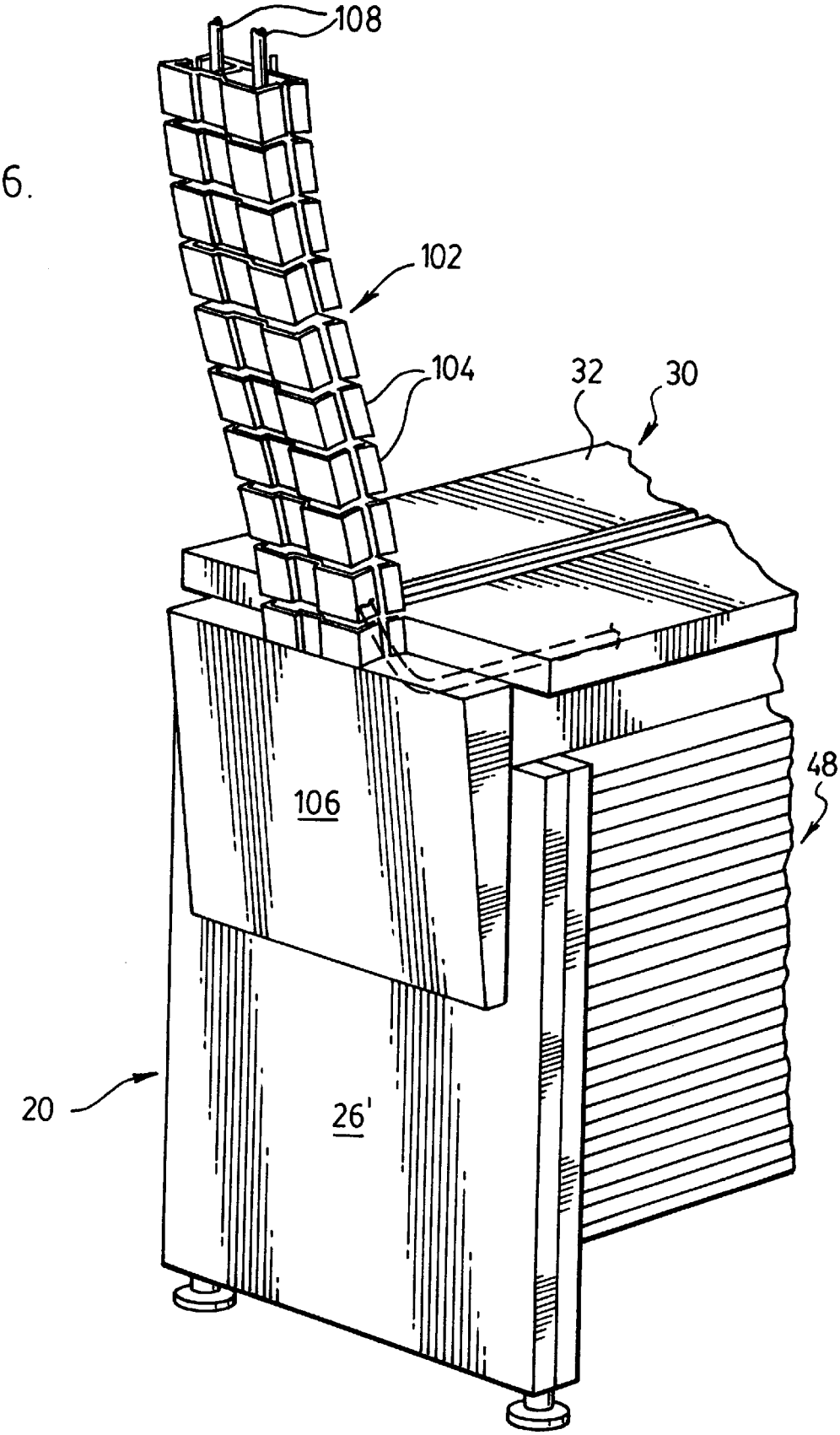

Finally, FIG. 6 shows an alternative method of coupling power and communications cables to the service trunk. As noted previously, so-called power columns or power poles traditionally are used to deliver power from an overhead supply location to a desk at floor level. FIG. 6 illustrates what may be characterized as a flexible power column coupling for delivering power and communications cables to the service trunk. As shown in FIG. 6, the power column itself is generally denoted 102 and comprises a series of tubular segments that are articulated with respect to one another so that the configuration of the conduit can be changed. Typically, the conduit 102 is a plastic moulding comprising relatively rigid segments 104 and flexible connections between the segments. At the bottom end of the conduit is a fixture 106 that is attached to an end of the trunk so that cables (108) within the conduit 102 can be routed into the service trunk without being exposed at the exterior of the trunk.

In summary, the present invention provides a new approach to workstation system design, that relies on the use of a service trunk as a core element of the system. The service trunk provides power and communications services to appropriate locations on the trunk. Desk structures are provided in association with the trunk, either as free-standing desks adjacent the trunk, or as desk structures that are semi-suspended from the trunk. At the same time, the top of the trunk provides a support for storage cabinets or other storage elements at a level above desk height.

In the particular embodiment illustrated, the service trunk also features relatively large open spaces at both sides below the top, which can accommodate floor-mounted storage cabinets. While this arrangement is believed to offer a number of advantages, it is to be understood that, within the broad scope of the invention, the storage trunk could have a different design. For example, the trunk could feature a platform at floor level and a series of floor level storage cabinets supported on the platform and in turn supporting the top of the storage trunk.

It will of course be appreciated that other modifications may be made within the broad scope of the invention, some of which have been indicated previously and others of which will be apparent to a person skilled in the art. For example, instead of the described arrangement of providing power bars (bar 36) for delivering power and data to desks associated with the service trunk, power cables could be run in a trough such as trough 80 or 82 (FIG. 3) and the trough could be provided with a series of electrical receptacles that are spaced along the outer face of each trough at locations selected to be conveniently accessible wherever desks are positioned longitudinally of the service trunk. This would lose the advantage of flexibility in position that comes with the use of power bars, but might be preferred in some applications. Similarly, VDMs could be mounted on the faces of the troughs.

It should finally be noted that references herein to "desks" should be interpreted broadly as meaning any structure that provides a work surface, i.e. is not limited to a structure at which a person sits to work. As such, the defined "working height" of the desk structure may be different depending on whether the structure is designed to accommodate a person who is sitting or standing while working.

We claim:

1. A workstation system which includes a service trunk for use in association with at least one desk providing a work surface at a defined working height with respect to the service trunk, the service trunk comprising an elongate self-standing structure having first and second ends spaced longitudinally of the service trunk and a top that extends between the ends at a height above said defined working height and that provides a generally horizontal storage support surface, the service trunk further including means for delivering at least one of power and communication services from an input location on the trunk to an output location accessible from a said desk associated with the trunk;

wherein the service trunk comprises a pair of cable ends that support opposite end portions of the top of the service trunk, and an upright median panel that extends between the gables below the top generally on the longitudinal centreline of the trunk;

wherein said upright median panel has opposite faces, each of which is provided with an array of horizontal slots that extend longitudinally of the panel, each slot having an undercut T-shape in cross-section, whereby the slots provide multiple locations at which accessories can be hooked onto the panel; and, wherein said means for delivering at least one of power and communication services comprises at least one power bar electrically coupled to a power supply from said input location, the power bar including a plurality of electrical outlets and being provided with hook means engageable in a said slot in the median panel of the service trunk, whereby the power bar can be selectively positioned on the surface of said median panel by selecting a particular said slot and a location longitudinally of that slot corresponding to the required location for the power bar.

2. A workstation system as claimed in claim 1, wherein said means for delivering at least one of power and communication services comprises cable troughs extending longitudinally of both sides of the service trunk, below the top and above said defined said working height of the desk, and along which at least one of power and communication service cables extends from said input location to a plurality of output locations spaced along the service trunk.

3. A workstation system as claimed in claim 2, wherein both power and data communication services are provided, and wherein said cable troughs comprise, at each side of the service trunk, separate troughs for power cables and communication cables respectively, the troughs being spaced from one another height-wise of the trunk to permit separate access to cables within the respective troughs.

4. A workstation system as claimed in claim 3, wherein each of said cable troughs receiving communications cables includes at least one access door in an outer face of the trough for permitting user access to cables within the trough.

5. A workstation system as claimed in claim 1, in combination with a said at least one desk comprising upright end support means, a top that extends inwardly from the end support means, and means coupling an end of the top remote-from the end gable to said median panel of the service trunk.

6. A workstation system as claimed in claim 5, wherein said coupling means comprise a pair of support arms that extend outwardly from said top of the desk towards said median panel and that are spaced transversely of the top, each said arm having a hook formation at a distal end thereof, and a channel formation extending longitudinally of the median panel of the service trunk having a side limb onto which said hook elements can be engaged for coupling the desk to the median panel.

7. A workstation system as claimed in claim 1, wherein said top includes a slot that extends longitudinally of the top generally centrally thereof, for permitting coupling of accessories to said top.

8. A workstation system as claimed in claim 7, further comprising a screen engageable with said slot.

9. A workstation system as claimed in claim 7, further comprising a storage cabinet disposed on said generally horizontal storage support surface of the top, and provided with means engageable in said slot for locating the storage cabinet laterally with respect to the top.

10. A workstation system as claimed in claim 9, wherein said storage cabinet is stackable with at least one other storage cabinet, and is provided with a plurality of protrusions in a bottom surface thereof engageable in corresponding recesses in a top surface of said other cabinet, for locating the stacked cabinets laterally with respect to one another.

11. A workstation system as claimed in claim 10, wherein said slot in the service trunk top includes a pair of oppositely directed lateral grooves, and wherein said means coupling the storage cabinet to the top includes a plate assembly coupled to said protrusions at the underside of the storage cabinet and including hook elements engageable in said oppositely directed grooves, for restraining the cabinet against upward displacement with respect to the top of the service trunk.

12. A workstation system as claimed in claim 1, in combination with power column means for delivering power and communication services to said input location on the trunk from an overhead location, said power column means comprising a flexible column made up a plurality of tubular segments that are articulated with respect to one another, and a fixture at a lower end of the column coupled to an end of the trunk, and through which power and communication cables are routed from said overhead location, into the trunk.

13. A workstation system which includes a service trunk and at least one desk providing a work surface at a defined working height, the service trunk comprising an elongate self-standing structure having first and second ends spaced longitudinally of the service trunk and a top that extends between the ends at a height above said defined working height and that provides a generally horizontal storage support surface, the service trunk further including means for delivering at least one of power and communication services from an input location on the trunk to an output location accessible from said desk;

wherein the service trunk comprises a pair of gable ends that support opposite end portions of the top of the service trunk, and an upright median panel that extends between the gables below the top generally on the longitudinal centreline of the trunk;

wherein said at least one desk comprises upright end support means, a top that extends inwardly from the end support means, and means coupling an end of the top remote from the end gable to said median panel of the service trunk; and, wherein said coupling means comprise a pair of support arms that extend outwardly from said top of the desk towards said median panel and that are spaced transversely of the top, each said arm having a hook formation at a distal end thereof, and a channel formation extending longitudinally of the median panel of the service trunk having a side limb onto which said hook elements can be engaged for coupling the desk to the median panel.

14. A workstation system which includes a service trunk for use in association with at least one desk providing a work surface at a defined working height with respect to the service trunk, the service trunk comprising an elongate self-standing structure having first and second ends spaced longitudinally of the service trunk and a top that extends between the ends at a height above said defined working height and that provides a generally horizontal storage support surface, the service trunk further including means for delivering at least one of power and communication services from an input location on the trunk to an output location accessible from a said desk associated with the trunk;

wherein said top includes a slot that extends longitudinally of the top generally centrally thereof, for permitting coupling of accessories to said top; and, wherein the work station system further comprises a storage cabinet disposed on said generally horizontal storage support surface of the top and provided with means engageable in said slot for locating the storage cabinet laterally with respect to the top.

15. A workstation system as claimed in claim 14, herein said storage cabinet is stackable with at least one other storage cabinet, and is provided with a plurality of protrusions in a bottom surface thereof engageable in corresponding recesses in a top surface of said other cabinet, for locating the stacked cabinets laterally with respect to one another.

16. A workstation system as claimed in claim 15, wherein said slot in the service trunk top includes a pair of oppositely directed lateral grooves, and wherein said means coupling the storage cabinet to the top includes a plate assembly coupled to said protrusions at the underside of the storage cabinet and including hook elements engageable in said oppositely directed grooves, for restraining the cabinet against upward displacement with respect to the top of the service trunk.

* * * * *